US012139970B2

(12) United States Patent
Rakvaag et al.

(10) Patent No.: US 12,139,970 B2
(45) Date of Patent: Nov. 12, 2024

(54) MODULE-BASED SYSTEM FOR PLUG AND ABANDONMENT OPERATION OF WELLS ON AN OFFSHORE INSTALLATION

(71) Applicant: Axess Technologies AS, Molde (NO)

(72) Inventors: Fredrik Haavard Rakvaag, Molde (NO); Stian Blö, Molde (NO); Torstein V. Svendsgaard, Molde (NO); Kjetil Vaseng, Molde (NO)

(73) Assignee: Axess Technologies AS, Molde (NO)

( * ) Notice: Subject to any disclaimer, the term of this patent is extended or adjusted under 35 U.S.C. 154(b) by 0 days.

(21) Appl. No.: 18/254,257

(22) PCT Filed: Dec. 7, 2021

(86) PCT No.: PCT/NO2021/050252
§ 371 (c)(1),
(2) Date: May 24, 2023

(87) PCT Pub. No.: WO2022/124905
PCT Pub. Date: Jun. 16, 2022

(65) Prior Publication Data

US 2024/0003195 A1 Jan. 4, 2024

(30) Foreign Application Priority Data

Dec. 7, 2020 (NO) ..... 20201343

(51) Int. Cl.
*E21B 15/00* (2006.01)
*E21B 15/02* (2006.01)
(Continued)

(52) U.S. Cl.
CPC ..... *E21B 15/003* (2013.01); *E21B 15/02* (2013.01); *E21B 19/002* (2013.01);
(Continued)

(58) Field of Classification Search
CPC ..... E21B 15/003; E21B 15/02; E21B 19/002; E21B 19/06; E21B 19/14
See application file for complete search history.

(56) References Cited

U.S. PATENT DOCUMENTS 9,051,783 B2 * 6/2015 Croatto ..... E21B 19/006
9,109,406 B2 8/2015 Lammertink
(Continued)

FOREIGN PATENT DOCUMENTS

WO 2011135541 A2 11/2011
WO 2014162128 A1 10/2014
WO 2017091142 A1 6/2017

OTHER PUBLICATIONS

International Search Report and Written Opinion mailed Feb. 23, 2022 for International Patent Application No. PCT/NO2021/050252.
(Continued)

*Primary Examiner* — Matthew R Buck
(74) *Attorney, Agent, or Firm* — Alix, Yale & Ristas, LLP

(57) ABSTRACT

A module-based system for plug and abandonment operation of wells on an offshore installation, wherein the module-based system is installed at same level as main rig or on below decks, wherein the module-based system is adapted to operate independent of main drilling tower or external rigs on the offshore installation by comprising modules coupled to perform all plug and abandonment operations, including integrated material handling modules.

20 Claims, 18 Drawing Sheets

(51) Int. Cl.
*E21B 19/00* (2006.01)
*E21B 19/06* (2006.01)
*E21B 19/14* (2006.01)

(52) U.S. Cl.
CPC ..... *E21B 19/008* (2013.01); *E21B 19/06* (2013.01); *E21B 19/14* (2013.01)

(56) References Cited

U.S. PATENT DOCUMENTS

| | | | | |
|---|---|---|---|---|
| 9,341,025 | B2 * | 5/2016 | Labrugere | E21B 19/004 |
| 2008/0156494 | A1 | 7/2008 | Abadie | |

OTHER PUBLICATIONS

International Preliminary Report on Patentability dated Feb. 24, 2023 for International Patent Application No. PCT/NO2021/050252.

* cited by examiner

MODULE-BASED SYSTEM FOR PLUG AND ABANDONMENT OPERATION OF WELLS ON AN OFFSHORE INSTALLATION

BACKGROUND

The disclosed embodiments relate to a module-based system for plug and abandonment operation of wells on an offshore installation.

The disclosure is especially related to a module-based system consisting of portable modules with lifting and skidding mechanisms allowing high risk operations (material handling above live wells) for plug and abandonment operations on an offshore installation deck.

Hydrocarbon fluids are produced through a well penetrating into a subterranean formation, referred to as the reservoir. When the reservoir is emptied, the pressure falls in the reservoir, and the flow of hydrocarbon fluids to the surface is reduced. The well has at this point reached the end of its life and it must be permanently plugged and abandoned. Regulatory authorities, managing the petroleum activities, have requirements for how the well should be plugged and abandoned that the operator must adhere to.

Wells can also be temporary plugged before a new side track to the existing well is drilled. This is performed to tap into a different part of the reservoir and extend the life of the well.

The well consists of an outer conductor, overlapping casing strings, well head and production tubing. The production tubing is in the center of the well going from the reservoir to surface or seabed. The production tubing is used to transport the hydrocarbons up from the reservoir and to the surface.

The purpose of the plugging is to prevent leakage of hydrocarbon, formation fluids or well fluids to environment when the well is abandoned. The industry and regulatory authority standards demand two independent barrier i.e.—two cement plugs. The plug should be established as a rock-to-rock barrier.

In order to establish the rock-to-rock barrier, the casing and tubing must be removed to expose the rock. Several ways to perform this operation exists in todays marked; cut-and-pull, casing milling, section milling, etc. All these methods are using topside equipment and tools at the existing drilling rig or external rigs (installed at the same level as the main rig) to perform the necessary downhole operations.

SUMMARY

Provided herein is a module-based system plug and abandonment operation of wells on an offshore installation partly or entirely solving the mentioned drawbacks of prior art solutions.

Provided herein is a modular system for topside package for plug and abandonment operations.

The module-based system is adapted to be arranged on a deck below the main rig and skidding deck.

The module based system comprises modules needed for performing plug and abandonment operations.

Typical modules for performing plug and abandonment operations are:

Operational capabilities
Jack landing string and tubing
Handle pipe to/from well center
Cut tubing into smaller segments
Break out make up landing string/tubing Working in low overhead areas—Limited available lifting height Accordingly, the disclosed embodiments provide a module-based system for plug and abandonment operation of wells on an offshore installation, wherein the module-based system is installed at same level as main rig or on below decks, wherein the module-based system is adapted to operate independent of main drilling tower or external rigs on the offshore installation by comprising modules coupled to perform all plug and abandonment operations, including integrated material handling modules.

According to one embodiment the module-based system is adapted to be built in situ without the need for external material handling devices by the integrated material handling modules.

In accordance with a further embodiment the module-based system comprises a frame module placed on the deck acting as a foundation for all other modules, said frame module have a telescopic extension to adjust the height of said frame module.

According to one embodiment the module-based system comprises a lift module that can hoist/lower modules or objects from deck level to correct height above deck.

In accordance with one embodiment the module-based system comprises a jack module comprising upper and lower jack segments that can be opened in two or more sections, moved in and out of well center and rotated, wherein an actuator for operation thereof extends though the lower segment jack segment so that the actuator protrudes below the lower jack segment.

According to one embodiment the integrated material handlings modules are adapted for handling of blowout preventer, high pressure riser, wireline blowout preventer, wireline riser and topside completion equipment for a well.

In accordance with one embodiment the module-based system comprises hatches arranged to travel on dedicated rails in the frame module for opening or closing an opening in the deck and/or closing around objects extending through the opening in the deck.

According to one embodiment the module-based system comprises a transport trolley module arranged to travel on dedicated rails in the frame module for transport of objects to and from well center.

In accordance with one embodiment the module-based system comprises a winch with redundant load paths, designed such that if one winch system fails the other shall remain intact and the load shall not drop.

According to one embodiment the lift module is provided with an A-frame and winch that can be tilted in and out of well center, said A-frame and winch can be used to run wireline as an integrated part of the module-based system.

In accordance with one embodiment the module-based system comprises a basket module adapted for storing pipes in a vertical position, said basket module is compatible with a pipe manipulator module for handling the vertical pipes in and out of well center.

According to a further embodiment the module-based system comprises a cutter work deck module and/or tong work module.

In accordance with a further embodiment of the module-based system, the overall dimensions and weight of the respective modules is designed to make them suitable for use on fixed installations offshore.

According to a further embodiment the modules are provided with quick connections used to connect energy to the modules.

In accordance with a further embodiment the module-based system comprises a common and central control system for all modules and functions so that said modules and functions are controlled by one system and with internal interlockings where needed.

Further preferable features and advantageous details of the present invention will appear from the following example description, claims and attached drawings.

BRIEF DESCRIPTION OF THE DRAWINGS

The present invention is below described in further detail with references to the attached drawings, where.

DETAILED DESCRIPTION

Figure 1:
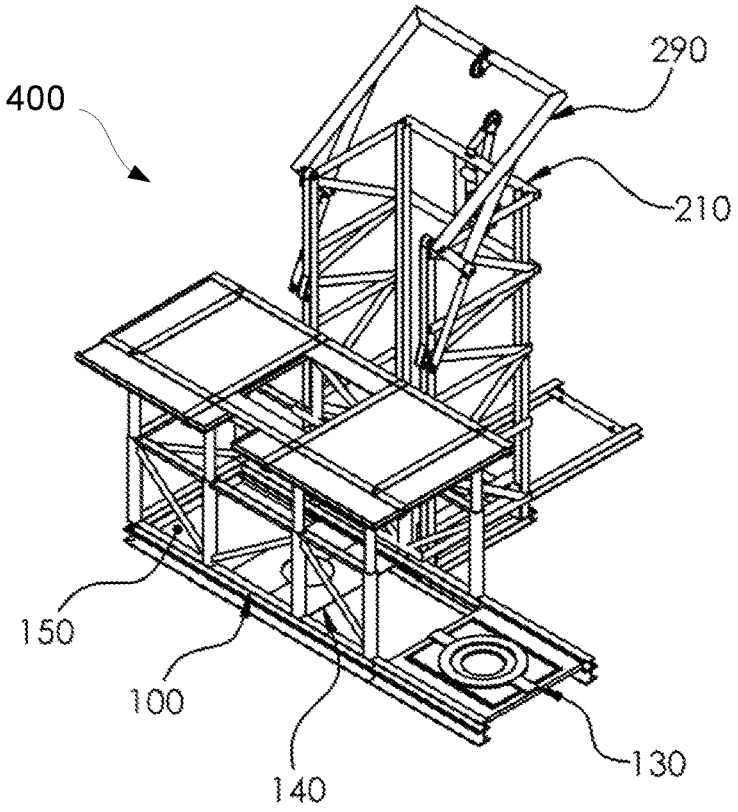
FIG. 1 is a principle drawing of a first embodiment of a system according to the disclosure, viewed in perspective.
Figure 2:
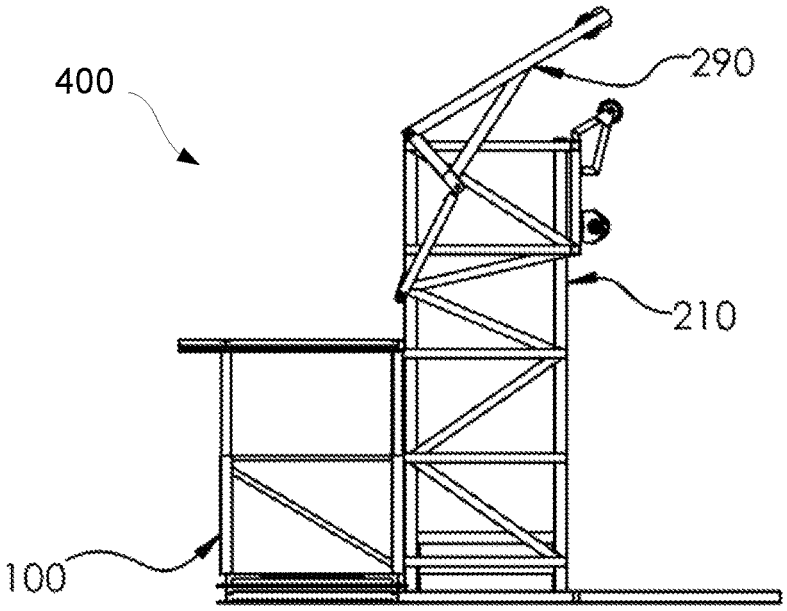
FIG. 2 is a principle drawing of the system in the FIG. 1, seen from the side.
Figure 3:
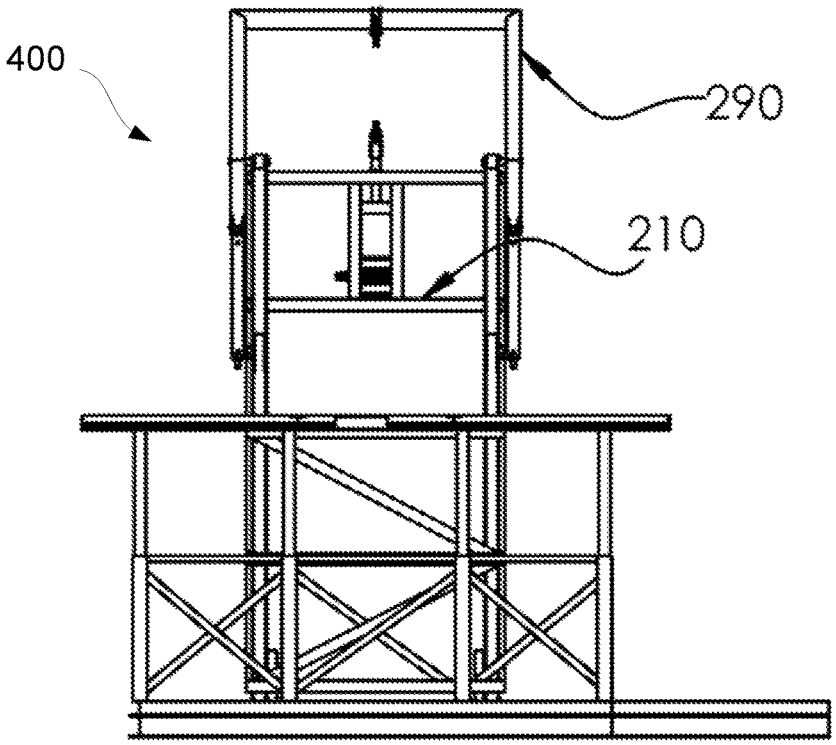
FIG. 3 is a principle drawing of the system in FIG. 1, seen from the front.
Figure 4:
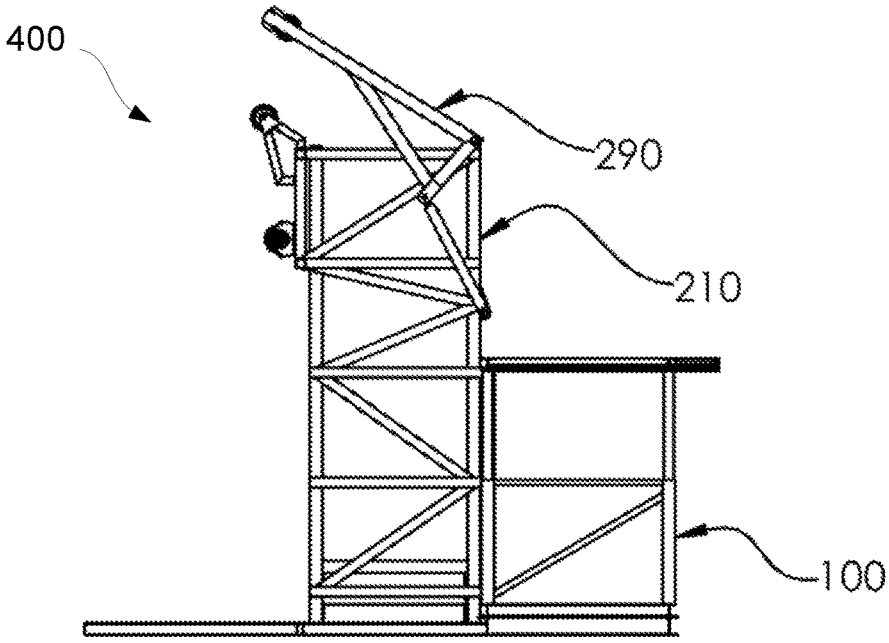
FIG. 4 is a principle drawing of the system in FIG. 1, seen from the side.
Figure 5:
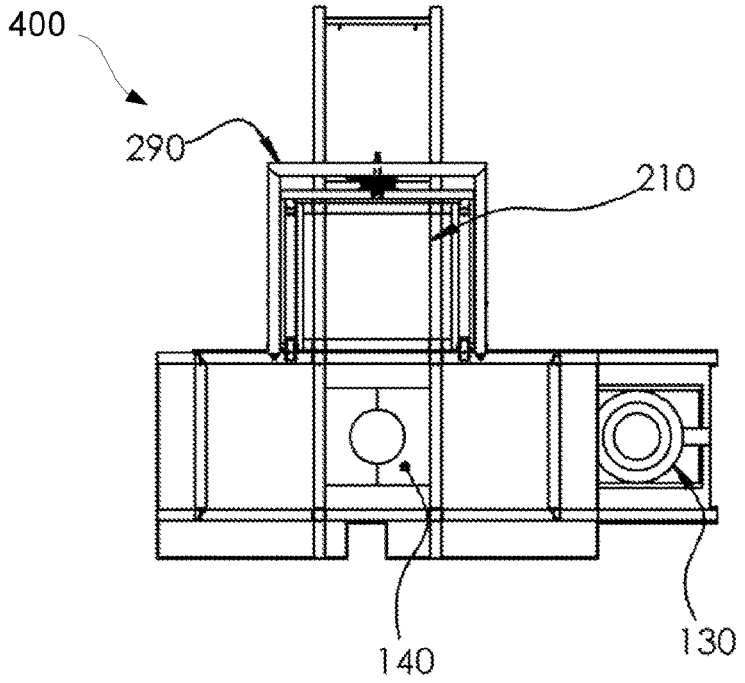
FIG. 5 is a principle drawing of the system in FIG. 1, seen from the top.

Reference is now made to FIGS. 1-5 showing principle drawings of a module-based system 400 for plug and abandonment operation of wells on an offshore installation, seen from perspective, side, front and top views.

The module-based system 400 comprises modules 100, 110, 120, 130, 140, 150, 160, 170, 180, 200, 210 coupled to perform all plug and abandonment operations, enabling the module-based system 400 to operate independent of main drilling tower 220 or external rigs.

According to one embodiment the modules 100, 110, 120, 130, 140, 150, 160, 170, 180, 200, 210 are provided with quick connections used to connect energy to the modules 100, 110, 120, 130, 140, 150, 160, 170, 180, 200, 210.

The module-based system 400 is installed on the same level as main rig 230 or on below decks on the offshore installation.

The module-based system 400 comprises modules 100, 110, 120, 130, 140, 150, 160, 170, 180, 200, 210 that enables the module-based system 400 to be built in situ without the need for external material handling devices, by comprises integrated modules 130, 160, 170, 200, 210 for material handling. The module-based system 400 is thus self-assembling.

The system 400 comprises frame module 100 to be arranged on a desired deck 240 of the offshore installation, e.g. blow-out-preventer deck, wherein the frame module 100 is acting as a foundation for all other modules. The frame module 100 is provided with a telescopic extension to adjust the height of said frame module.

The module-based system 400 further comprises a lift module 210 (offshore installation and lift module) that is to be used both during installation of the module-based system 400, as well as for hoisting/lowering modules or objects from deck level to correct height above deck, hereunder also adjustment of the height of the frame module 100.

Figure 6:
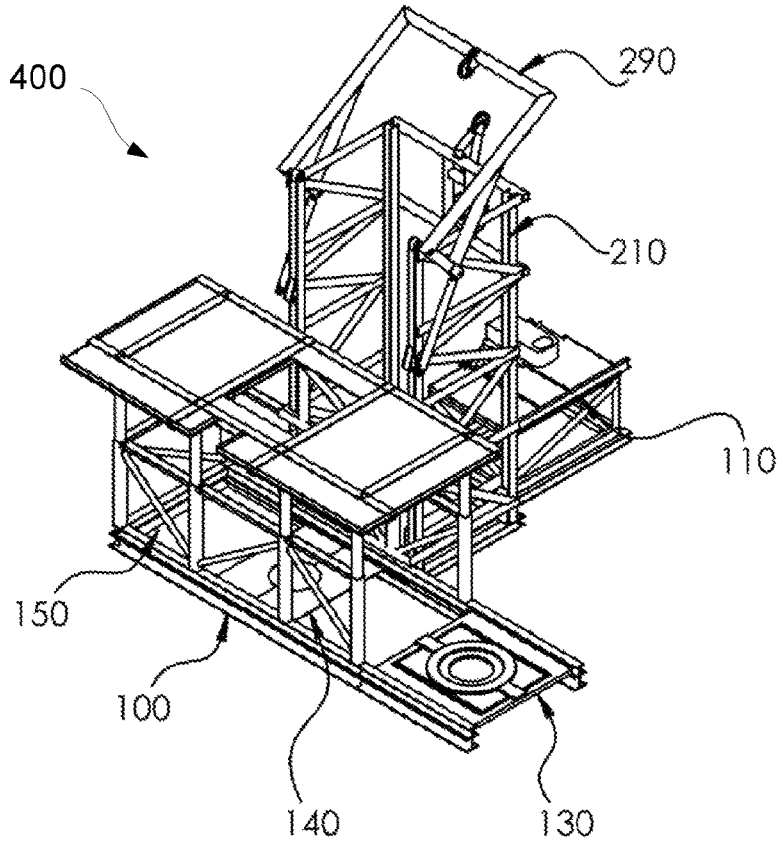
FIGS. 6-9 are principle drawings of a second embodiment of the system according to the disclosure.
Figure 7:
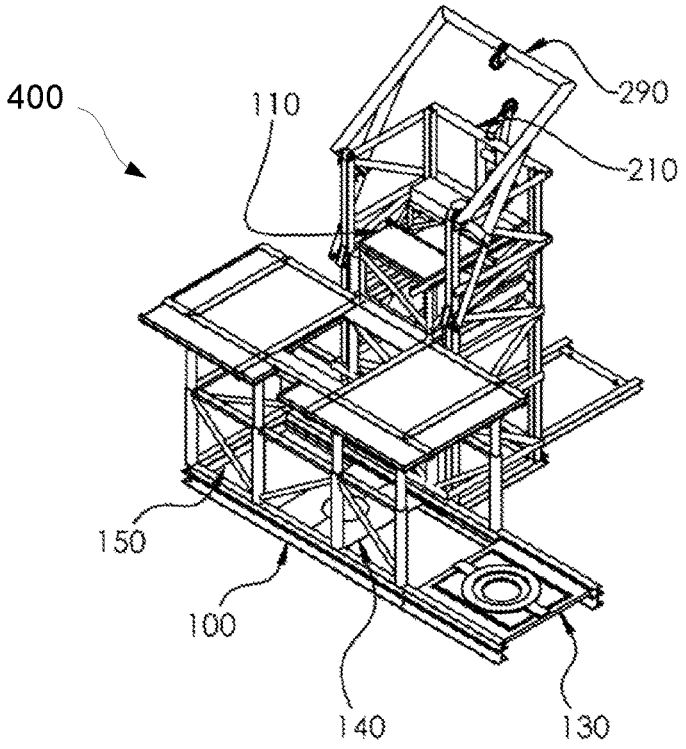
Figure 8:
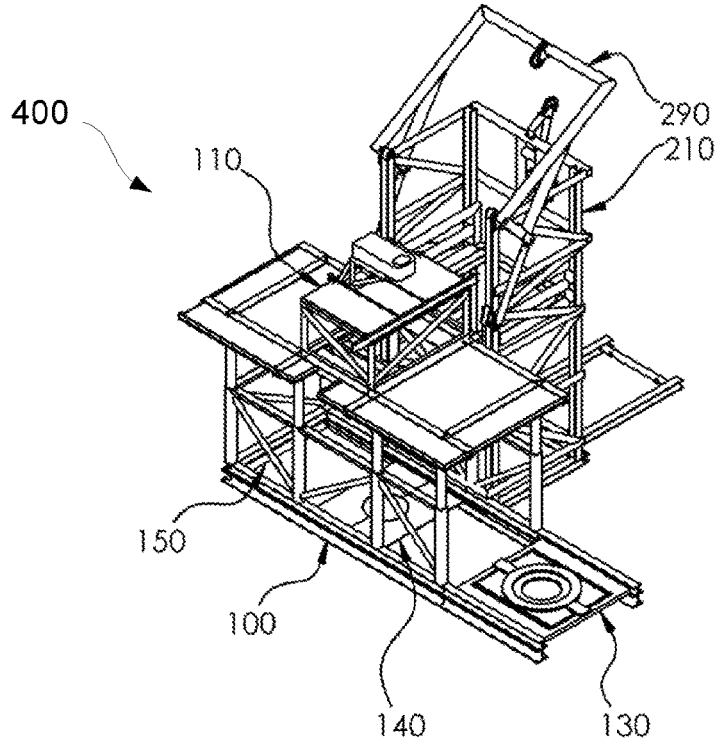
Figure 9:
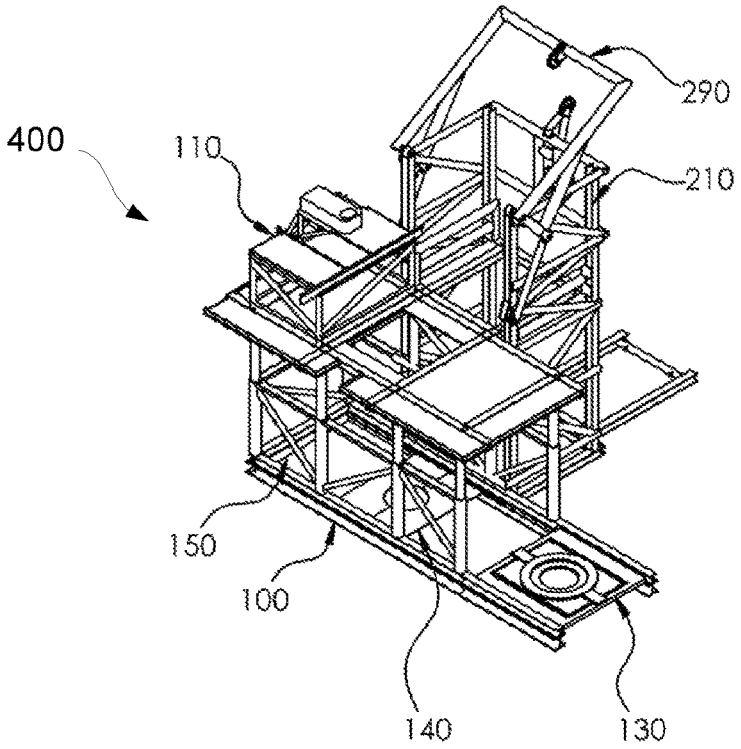

Reference is now made to FIGS. 6-9 showing principle drawings of a second embodiment of the module-based system 400, wherein the module-based system 400 further comprises a cutter work deck module 110, and wherein the FIGS. 6-9 show installation of the cutter work deck module 110. In FIG. 6 is shown the cutter work deck module 110 placed on the deck 240 ready to be installed. In FIG. 7 is shown the cutter work deck module 110 hoisted using the lift module 210 to correct height in relation to the frame module 100 height. In FIGS. 8 and 9 is shown the cutter work deck module 110 skidded in the horizontal plane, in a perpendicular direction of the length of the frame module 100 and into a desired position on a platform of the frame module 100.

Figure 10:
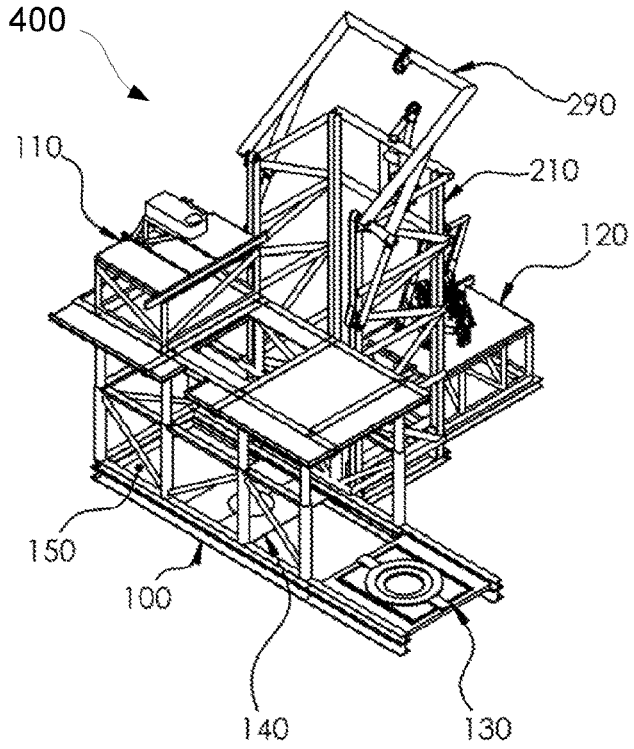
FIGS. 10-13 are principle drawings of a third embodiment of the system.
Figure 11:
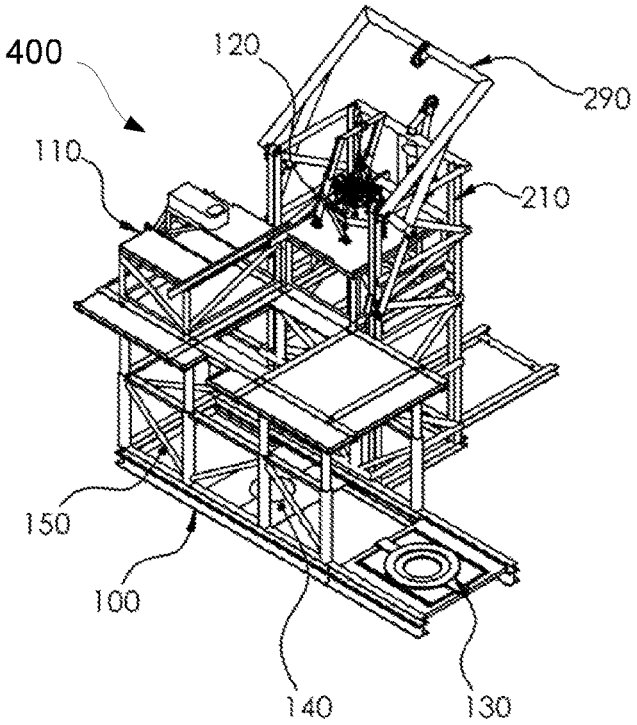
Figure 12:
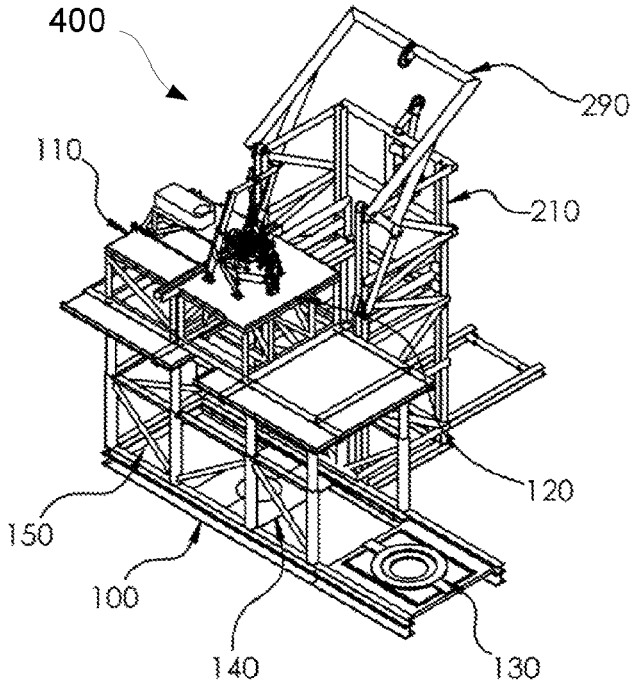
Figure 13:
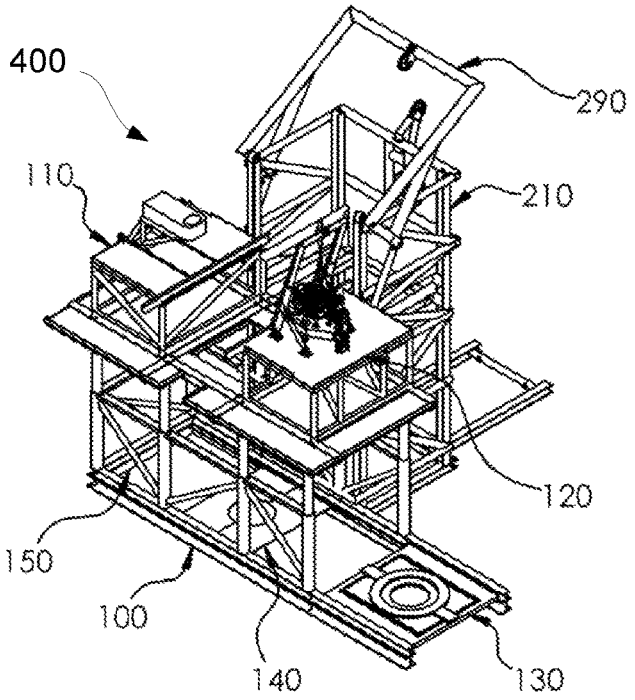

Reference is now made to FIGS. 10-13 showing principle drawings of a third embodiment of the module-based system 400, wherein the module-based system comprises a casing tong work deck 120, and wherein the FIGS. 10-13 show installation of the casing tong work deck module 120. In FIG. 10 is shown the casing tong work deck module 120 placed on deck 240, ready to be installed. In FIG. 11 is shown the casing tong work deck module 120 hoisted by using the lift module 210 to correct height in the frame module 100. In FIGS. 12 and 13 is shown the casing tong work deck module 120 skidded in horizontal plane, in a perpendicular direction to the length of the frame module 100 and into a desired position on a platform of the frame module 100.

Figure 14:
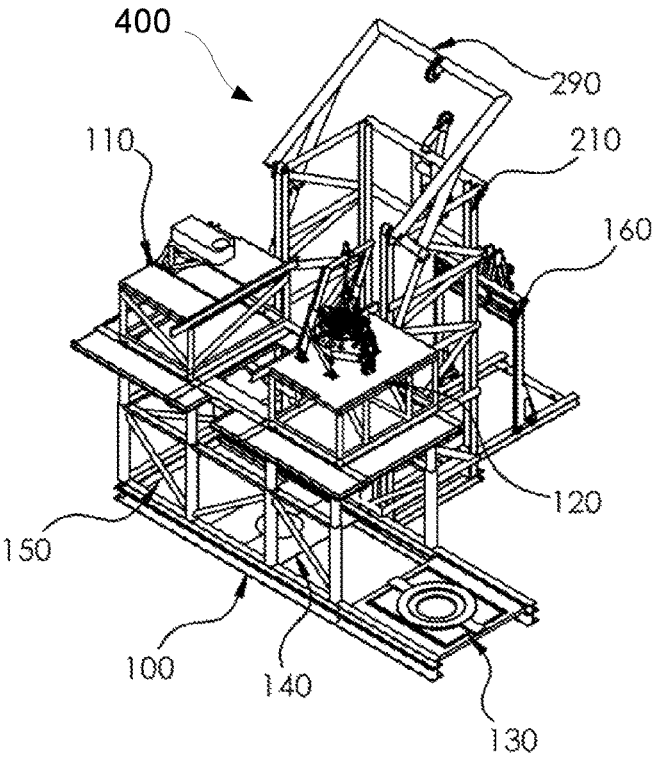
FIGS. 14-16 are principle drawings of a fourth embodiment of the system.
Figure 15:
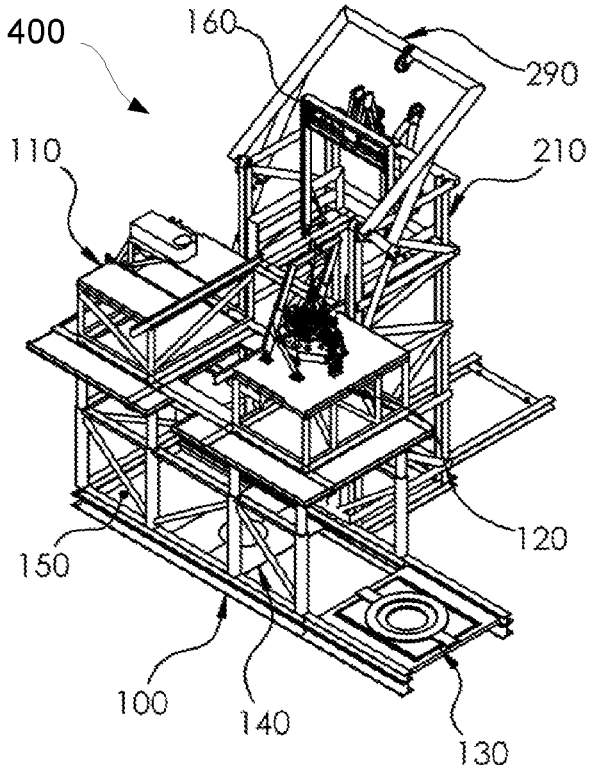
Figure 16:
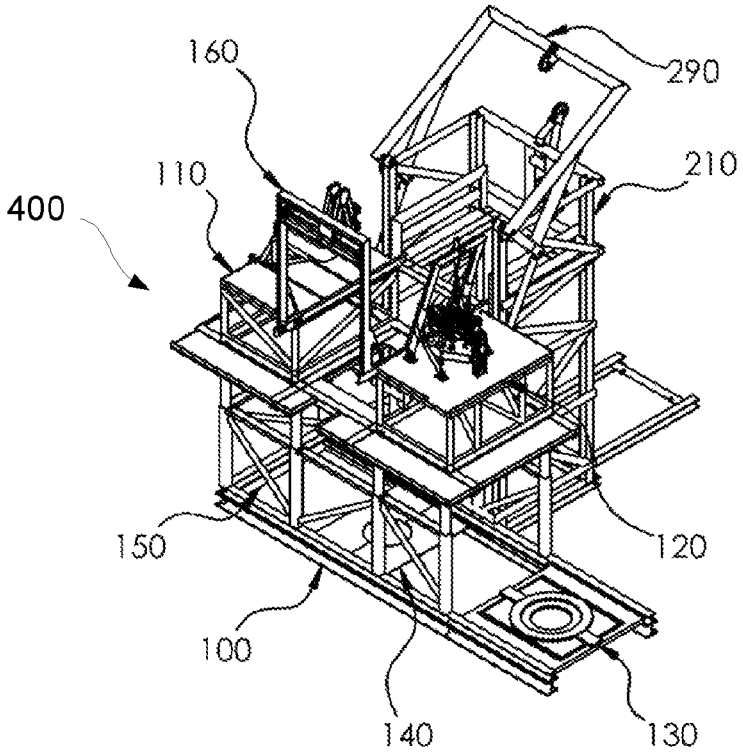

Reference is now made to FIGS. 14-16 showing principle drawings of fourth embodiment of the module-based system 400, wherein the module-based system 400 a pipe manipulator module 160, wherein the FIGS. 14-16 show installation of the pipe manipulator module 160. In FIG. 14 is shown the pipe manipulator 160 module placed on deck 240, ready to be installed. In FIG. 15 is shown the pipe manipulator module 160 hoisted by the lift module 210 to correct height in the frame module 100. In FIG. 16 is shown the pipe manipulator module 160 transferred to rails on frame module 100 and moved into desired position in the frame module 100, between the mentioned modules 110 and 120, described above.

Figure 17:
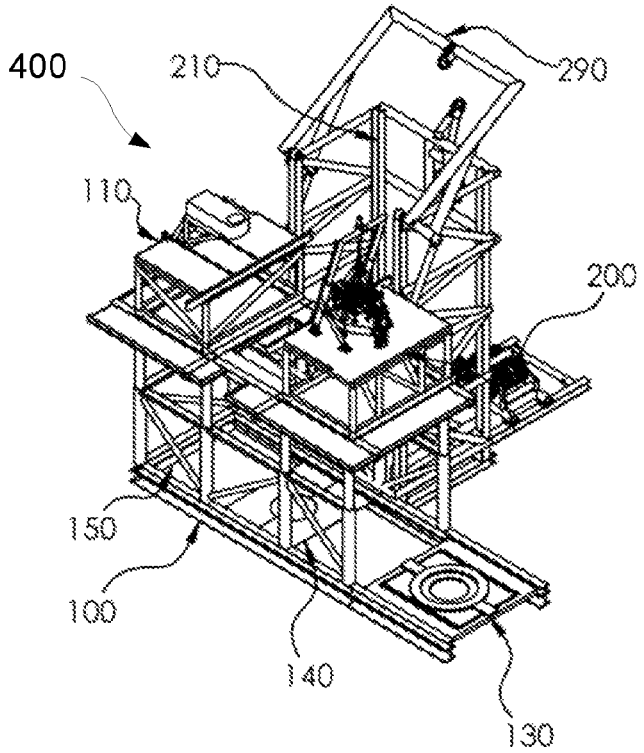
FIGS. 17-19 are principle drawings of a fifth embodiment of the system.
Figure 18:
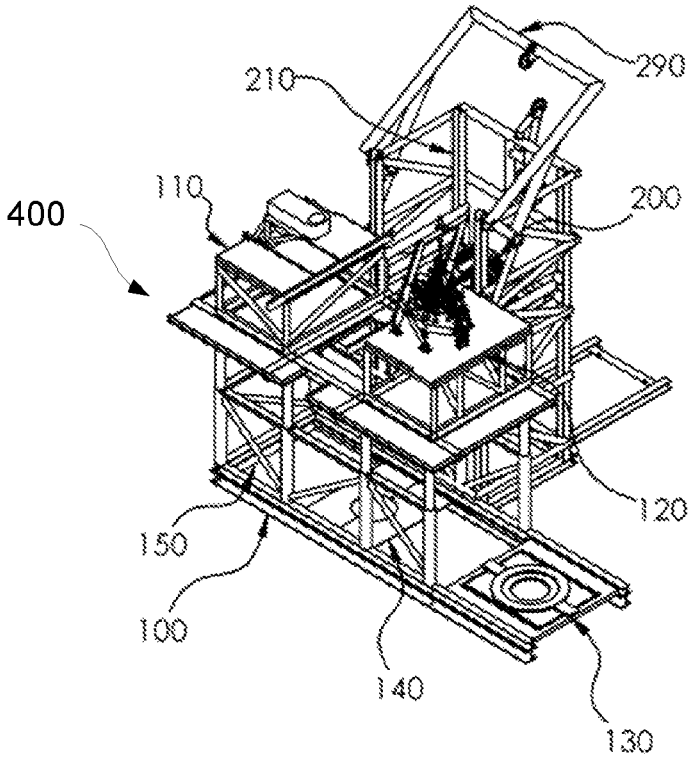
Figure 19:
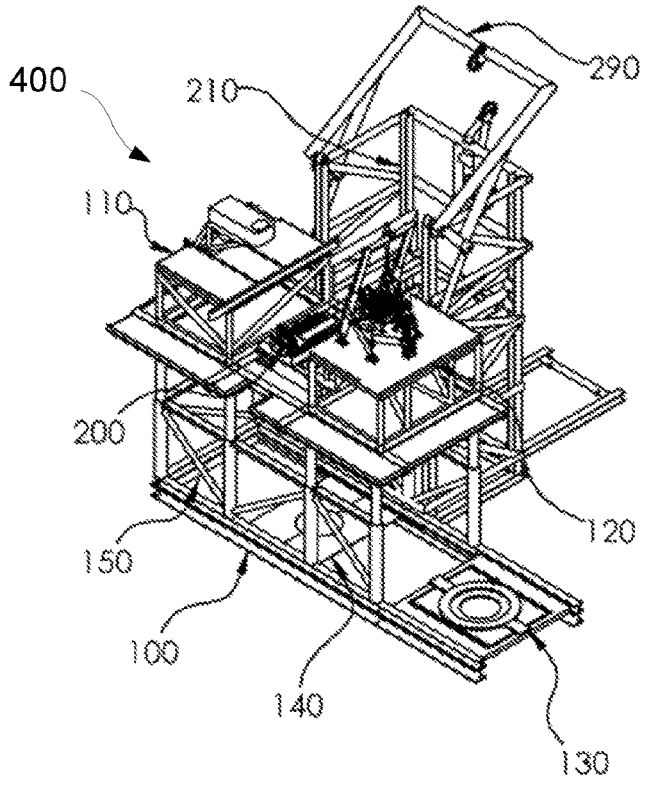

Reference is now made to FIGS. 17-19 showing principle drawings of a fifth embodiment of the module-based system, wherein the module-based system 400 comprises a winch module 200, e.g. a dual secured winch module, wherein the FIGS. 17-19 show installation of the winch module 200. In FIG. 17 the winch module 200 is placed on the deck 240, ready to be installed. In FIG. 18 the winch module 200 is hoisted to correct height in the frame module 100 using the lift module 210. In FIG. 19 the hoisted winch module 200 is skidded in the horizontal plane, in a perpendicular to the length of the frame module 100, and moved into a desired position on a platform of the frame module 100, which in the shown example is between the modules 110 and 120.

Figure 20:
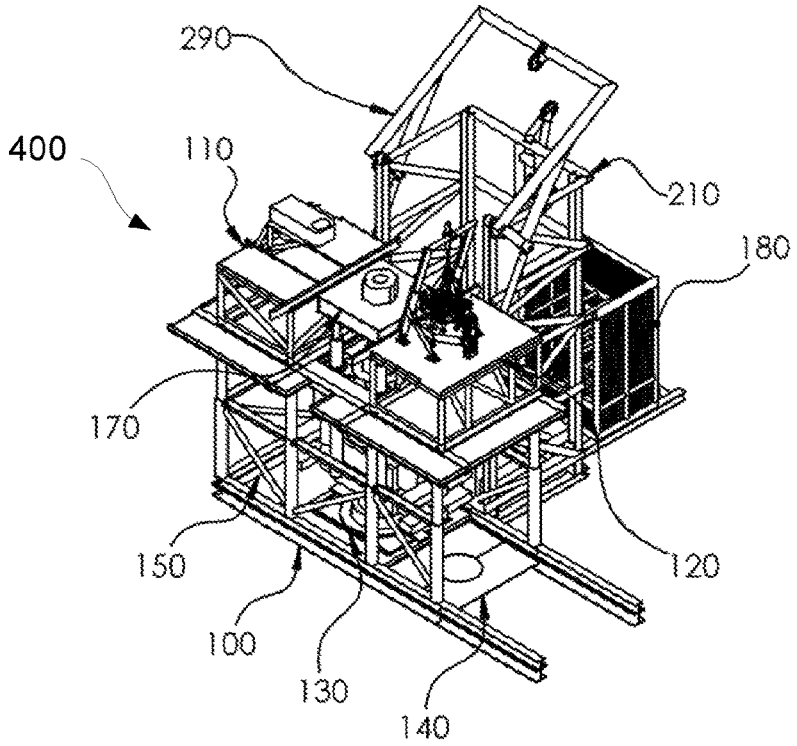
FIGS. 20-21 are principle drawings of a sixth embodiment of the system.
Figure 21:
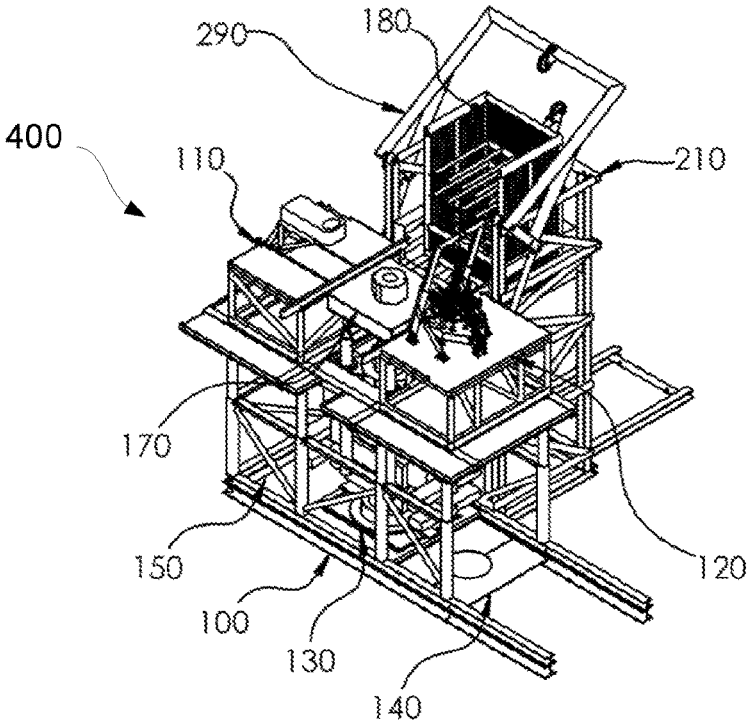

Reference is now made to FIGS. 20-21 showing principle drawings of a fifth embodiment of the module-based system 400, wherein the module-based system 400 comprises a basket module 180, wherein the FIGS. 20-21 show the installation of the basket module 180. In FIG. 20 the basket module 180 is placed on the deck 240, ready to be installed. In FIG. 21 is shown the basket module 180 hoisted using the lift module 210 to correct height in the frame module 100.

Figure 22:
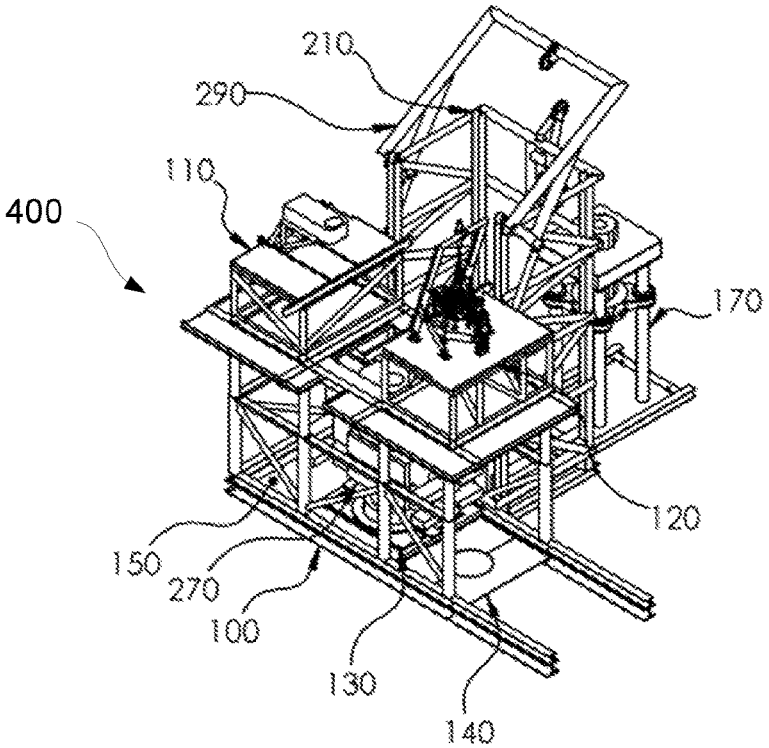
FIGS. 22-25 are principle drawings of a seventh embodiment of the system.
Figure 23:
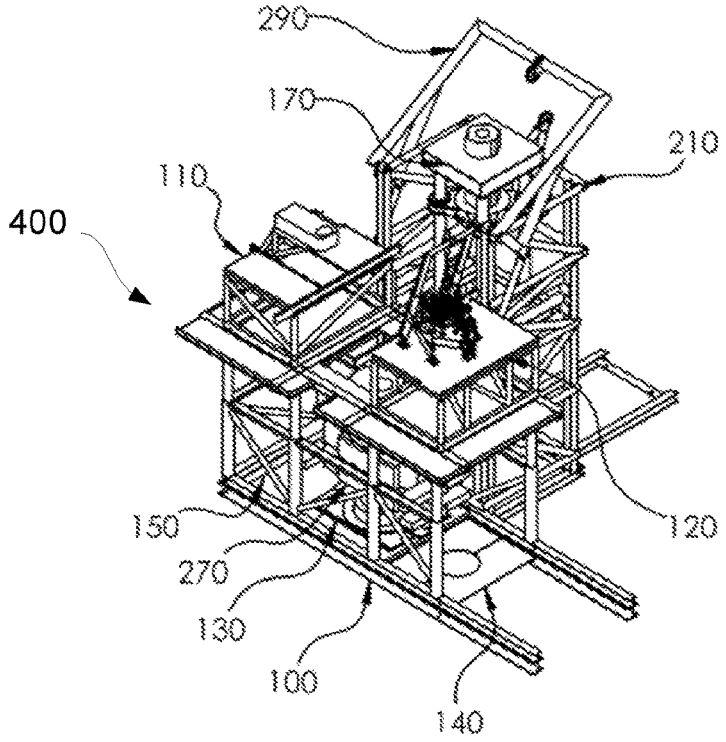
Figure 24:
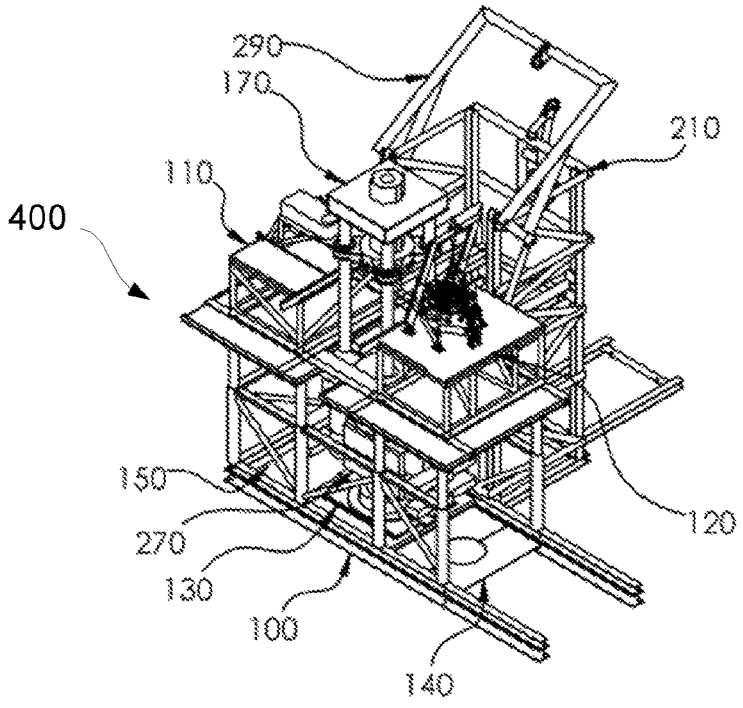
Figure 25:
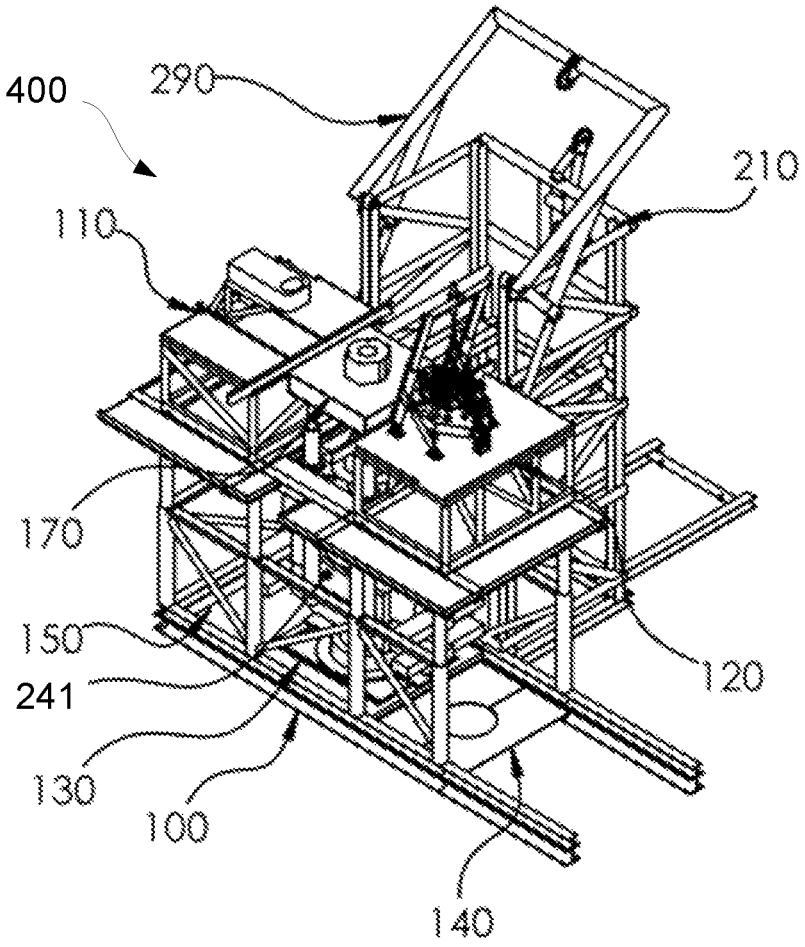

Reference is now made to FIGS. 22-25 showing a seventh embodiment of the module-based system 400, wherein the module based system 400 comprises a jack module 170, wherein the FIGS. 22-25 show the installation of jack module 170. In FIG. 22 the jack module 170 is placed on the deck 240, ready to be installed. In FIG. 23 the jack module 170 is hoisted using the lift module 210 to correct height in the frame module 100. In FIG. 24 the jack module 170 is skidded in the horizontal plane, in a perpendicular direction to the length of the frame module 100, and moved into a desired position on a platform of the frame module 100, which in the shown example is between the modules 110 and 120, which in the shown example also is a position that is coinciding with well center. In FIG. 25 is shown a position where the jack module 170 is lowered onto a blow-out-preventer 241.

Figure 26:
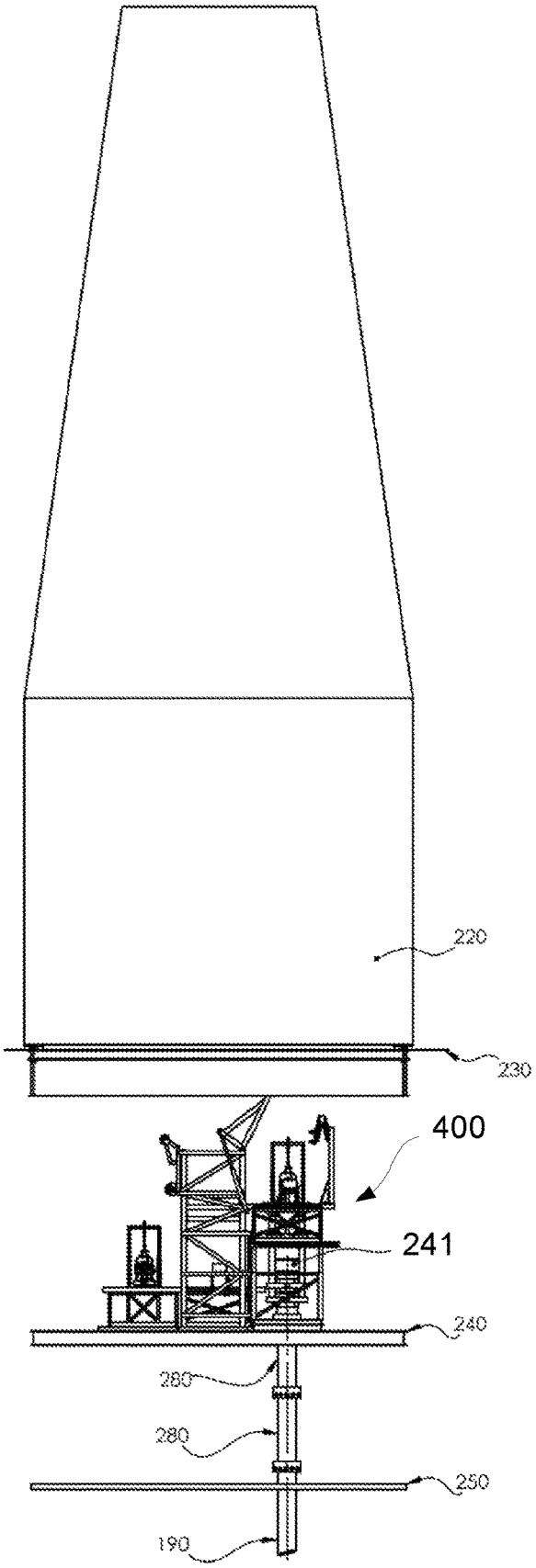
FIG. 26 is a principle drawing of the system installed on a BOP deck of a fixed installation.

Reference is now made to FIG. 26 showing a principle drawing where the module-based system 400 is installed on the blow-out-preventer deck 240 of an offshore installation, below the main drilling tower 220 of the offshore installation. The figure further shows lower risers 280 extending from a well head 190 and to the blow-out-preventer 241, as well as Christmas three deck 250.

Figure 27:
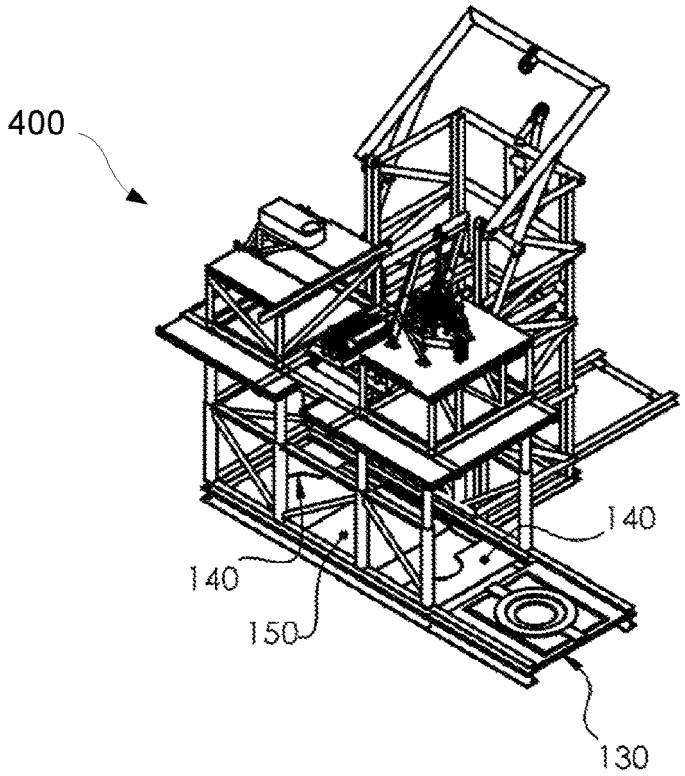
FIGS. 27-28 are principle drawings of making a barrier towards lower deck.

Reference is now made to FIGS. 27-30 showing principle drawings of further details of the module-based system 400. The frame module 100 has three integrated rail levels for arrangement of hatch modules 140 and 150, as wells as for a trolley module 130. The module-based system 400 comprises a hatch module 150 movable on the mentioned dedicated rail, extending in longitudinal direction of the frame module 100, wherein the hatch module 150 is movable between a closing position and an open position for opening and closing a hole in the deck 240 over the well center, respectively. In FIG. 27 is shown a situation where the hatch 150 is positioned in closing position wherein the hatch 150 closes the hole over the well center to make a barrier for dropped objects towards lower deck.

Figure 28:
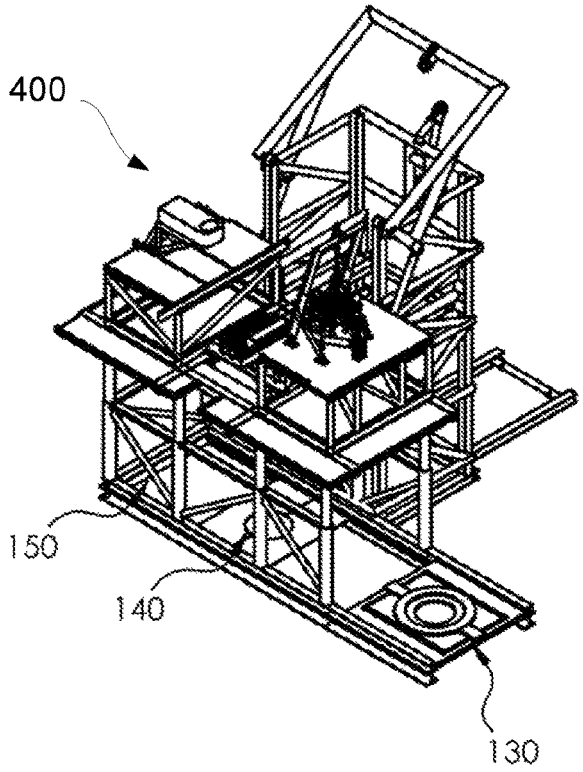
Figure 29:
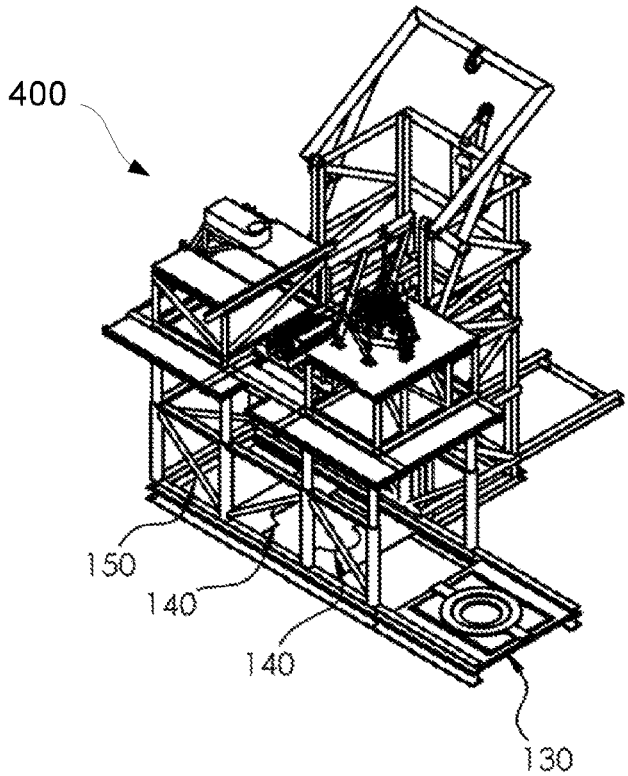
FIG. 29 is a principle drawing showing the system in an open position to the well center.
Figure 30:
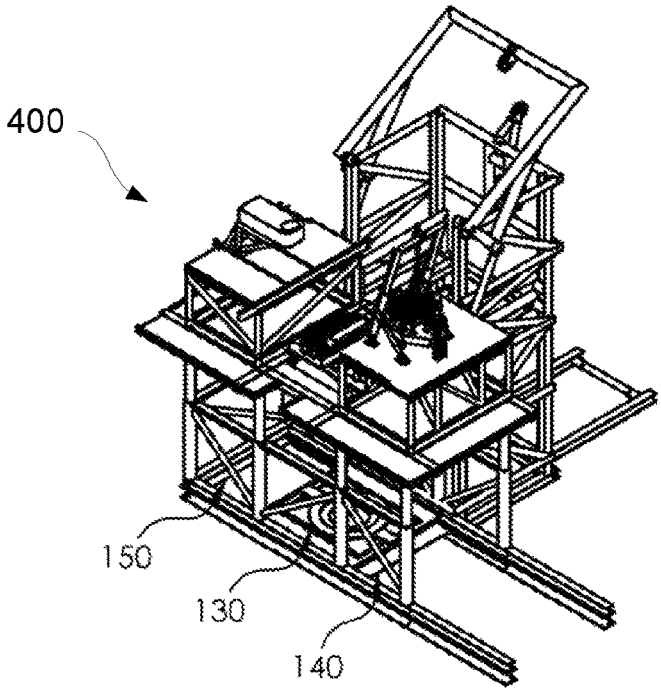
FIG. 30 is a principle drawing of a transport trolley of the system positioned in the well center.

In FIG. 28 is shown a further embodiment of the module-based system 400 where it comprises a split hatch 140, formed by two corresponding parts adapted to enclose circular objects when joined together. The respective parts of the split hatch 140 is arranged movable between a closing position and an open position over the hole in the deck 240 over the well center, wherein the respective parts of the split hatch 140 are arranged movable between open and closed position on dedicated rails, extending in longitudinal direction of the frame module 100, wherein the respective parts of the split hatch 140 is arranged to move in opposite direction on the mentioned dedicated rails. By this is enabled a hatch 140 that in closed position will enclose circular objects extending into the well and in this manner make a barrier towards lower then when in close position. FIG. 28 shows the split hatch 140 in closed position, while FIG. 29 shows the split hatch 140 in open position so that objects may be handled through the opening in the deck 240, e.g. objects from the Christmas three deck 250.

According to a further embodiment the module-based system 400 comprises a transport trolley module 130 arranged to move in longitudinal direction of the frame module 100 on dedicate rails, as shown in FIGS. 1, 5-25 and 27-30, wherein the transport trolley module 130 is movable between a position outside the mentioned platforms for modules 110, 120, 160, 170, 200 and to a position over the mentioned hole in the deck 240 over the well center.

In FIGS. 20-25 and 30 the transport trolley module 130 is positioned over the hole in the deck 240, while in FIGS. 1, 5-19 and 27-29 the transport trolley module 130 is shown in the position outside the mentioned platforms.

Figure 31:
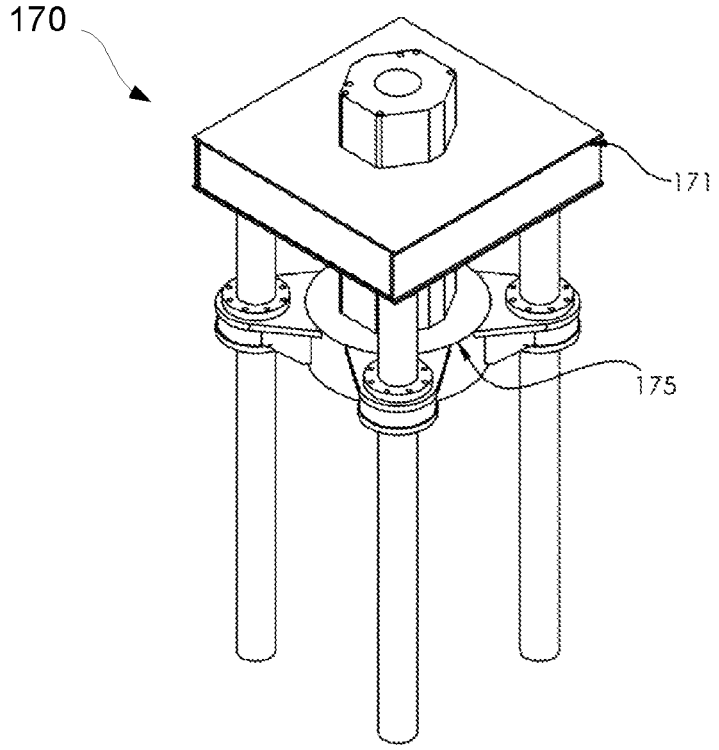
FIG. 31-32 are principle drawings of a jack according to the disclosure.
Figure 32:
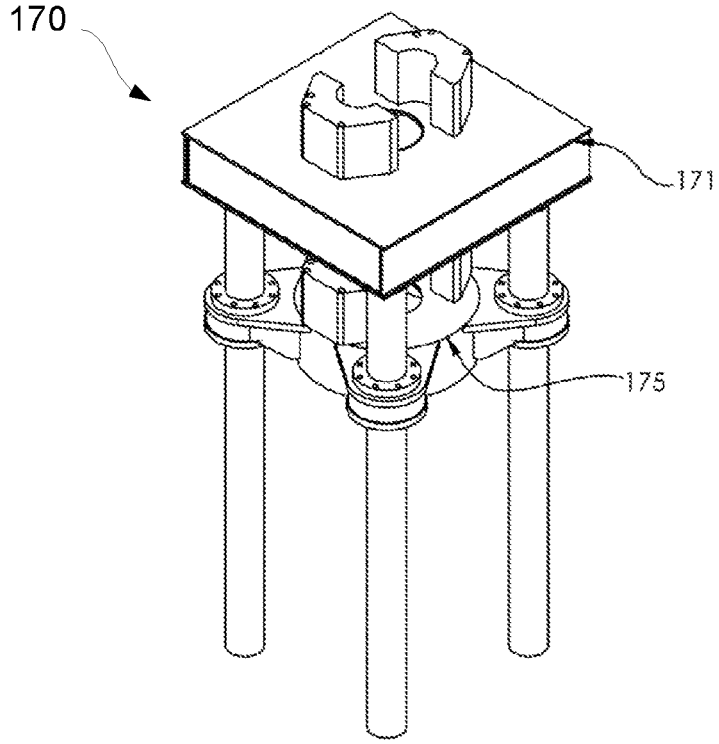

Reference is now made to FIGS. 31-32 showing details of the jack module 170. The jack module 170 comprises a movable upper jack segment and a lower stationary jack segment 175 operable between a closed position and an open position. In FIG. 31 the jack module 170 is shown in a closed position.

Figure 33:
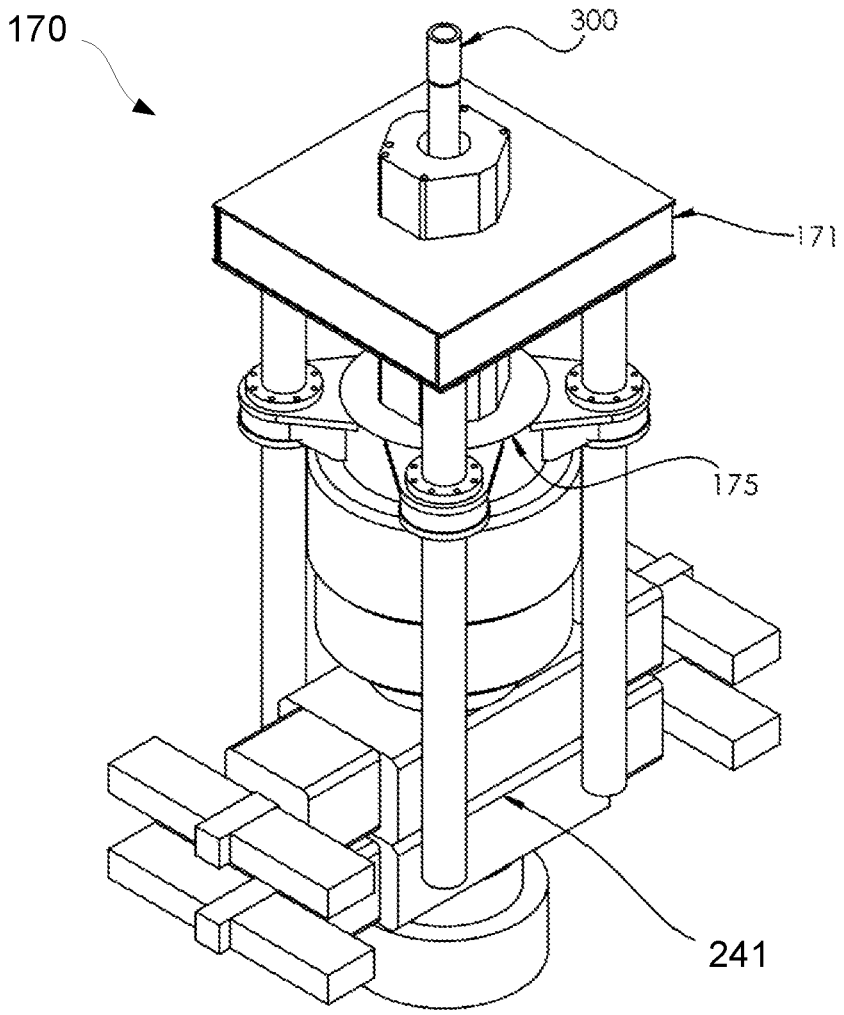
FIG. 33 is a principle drawing of a jack placed on top of a BOP.

In FIG. 32 the jack module 170 is shown in an open position, where the upper jack segment 171 and lower jack segment 175 is opened to allow large outer diameter objects to pass through the jack module 170. In FIG. 33 is shown an example of use, where the jack module 170 is placed on top of a blow-out-preventer 241 with a tubing 300 going through the jack module 170 and blow-out-preventer 241.

Installation of the Module-Based System on an Offshore Installation

The module-based system 400 is installed by lifting the frame module 100 100 and lift module 210 over the well. This is performed using the material handling solutions on the offshore installation. It is positioned so that the center of the frame module 100 corresponds with well center. This is shown in FIGS. 1-5. All other modules can be installed using the lift module 210 and internal skidding mechanisms on the frame module 100.

The work deck modules 110, 120 come with a preinstalled tubing cutter and casing tong, to be used during plug and abandonment operations. The work deck module 110, 120 is placed in the lift module 210 and lifted to the correct height, before they are skidded onto the frame module 100. The skidding motion is first perpendicular to the length of the frame module 100, to get the work deck module 110, 120 out of the lift module 210. The second skidding motion is parallel to the length of the frame module 100, to position the module 110, 120 in correct position. The lifting and skidding motion of the modules 110, 120 is illustrated in FIGS. 6-13.

The winch module 200, preferably in the form of a dual secured winch, can lift objects on the same deck level 240 as the frame module 100 or from the Christmas three deck below 250. With the winch module 200 installed, the module-based system 400 has the capabilities to hoist or lower objects with redundant load paths, meaning that if one winch system fails the other shall remain intact and the load shall not drop. Using such redundant system allows lifting of objects over wells without shutting the stream of hydrocarbons down (shut-in). The dual secured winch module 200 is installed by loading it into the lift module 210, hoist the lift module 210 to correct position and skid the winch module 200 out of the lift module 210 over well center. This is shown in FIGS. 17-19. It is removed by reversing these steps.

The jack module 170, which is mounted to a skidding frame, is installed by loading it into the lift module 210, hoist it to correct height and skidding it to well center, as shown in FIGS. 22-25. The jack module 170 is lowered onto the blow-out-preventer 241 by lowering the frame module 100. Demount lower locking of cylinders and lower cylinders until upper flanges rests on lower part of jack. Upper jack segment 171 is now supported by four supporting steel bars. Unlock pin bolts for supporting steel bars and lower upper jack segment 171. Unlock pin bolts in skidding frame and extend frame back in position. See FIGS. 22-25.

The pipe manipulator module 160 is transported into the lift module 210 and lifted to correct height where it is skidded onto corresponding rails on work deck modules 110, 120. See FIGS. 14-16.

Basket module 180 with pull string in vertical position is skidded into the lift module 210. Basket module 180 is secured and lift is extended to upper position. See FIGS. 20 and 21.

The frame module 100 has three integrated rail levels for the mentioned hatches 140 and 150, as well as the transport trolley module 130. The trolley 130 and hatches 140, 150 can travel along the dedicated rails, in and out of the frame module 100, independent of each other.

The transport trolley module 130 is used to transport objects in and out of well centre. Typical objects transported on the transport trolley module are blow-out-preventer 270, riser 280, deck hatch, X-mas tree etc. See FIG. 30. The transport trolley module has actuators that can adjust the position of the object by linear motion in three axis and rotation about the vertical axis.

The mentioned split hatch 140 is a set of two rectangular hatches, where each hatch has a semicircle slot, so that it can be closed around a riser section. See FIGS. 28 and 29. This creates a barrier for dropped objects towards deck Christmas three deck 250 below. The two split hatches 140 can travel in in and out of well center, where each hatch travels in opposite direction.

The auxiliary hatch 150 travels in and out of well center to close the open hole in the deck 240 when the permanent hatch that is present in the deck 240 is removed. This creates a barrier for dropped objects towards lower deck. See FIGS. 27 & 28.

Operation Description

FIG. 26 is showing a complete module-based system 400 installed at the blow-out-preventer deck 240 at the offshore installation. Module-based system 400 is built up of several of the mentioned modules that together give the module-based system 400 the capabilities to plug and abandon (P&A) a well.

The jack module 170 can jack landing string or tubing up and down. Two slips segments in the jack 170 can grip on smooth tubing and actuators will move the upper jack segment 171 and landing string/tubing in the direction that is demanded by the operation.

The mentioned pipe manipulator module 160 can grip around pipe segments and transport them in/out of well center to/from the basket module 180. The pipe manipulator module 160 is arranged to move linearly along three axes in the module-based system 400.

The casing tong work deck module 120 has an integrated lifting device for a casing tong. The lifting device can move the casing tong in and out of well center, to make up or break out pipe joints.

The cutter work deck module 110 has an integrated movable frame for a tubing cutter. The cutter can move in and out of well center to cut the tubing into smaller segments when it is jacked up.

The lift module 210 has an integrated lifting device to handle objects, and to be used as foundation for wire line operation.

Usage Examples

The usage of the module-based system 400 can be divided into different phases; well intervention, material handling of topside equipment, tubing retrieval, cementing, well abandonment.

In the well intervention phase the lifting module 210 is provided with an A-frame 290 used to perform wireline operations in the well separated from all other platform wireline systems.

Material handling of topside equipment uses the transport trolley module 130 and winch module 200 (dual secured winch) to lift the X-mas tree out from lower decks, lower risers 280 to the well head 190 and connect the blow-out-preventer 241 to the riser 280.

The jack module 170 is used in the tubing retrieval phase to jack tubing up or lower landing string down. The jack module 170 has a lower stationary jack segment 175, and upper movable jack segment 171 as shown in FIG. 31. When moving the pipe vertically it is gripped in the upper jack segment 171 of the jack module 170. The load can be transferred to the lower jack segment 175, and a re-positioning of the upper jack segment 171 can be performed. The existing tubing 300 in the well can be jacked up, and the integrated cutting module 110 and pipe manipulator module 160 can cut the existing tubing into smaller sections and place it back into the basket module 180. The process is repeated until a desired length of tubing is jacked up. The jack segments 171, 175 can be opened for allowing large object to pass through as demonstrated in FIG. 32. FIG. 33 is showing the jack module 170 installed on the blow-out-preventer 241 with the existing tubing 300 to be jacked up The module-based system 400 further comprises a common and central control system for all modules 100, 110, 120, 130, 140, 150, 160, 170, 180, 200, 210 and functions so that said modules and functions are controlled by one system and with internal interlockings where needed.

The above described embodiments may be combined to form modified embodiments within the scope of the attached claims.

The invention claimed is:

1. A module-based system (400) for material handling in connection with plug and abandonment operations of wells on an offshore installation comprising an upper main deck in the form of a main rig (230) and skidding deck and at least one lower deck (240-250) with limited available lifting height, comprising:

modules (100, 110, 120, 130, 140, 150, 160, 170, 180, 200, 210) configured to allow operation independently from a main drilling tower or external rigs on the upper main deck of the offshore installation, wherein the module-based system (400) is adapted and installed at the lower deck (240) of the offshore installation by a frame module (100) acting as a foundation for the other modules (100, 110, 120, 130, 140, 150, 160, 170, 180, 200, 210), said frame module (100) having a telescopic extension to adjust a height of said frame module (100) to the available lifting height, and the module-based system (400) is configured to perform all material handling operations in connection with the plug and abandonment operations via a lift module (210) and integrated material handling modules comprising a transport trolley module (130), a pipe manipulator module (160), a jack module (170) and a winch module (200) interchangeable with one another.

2. The module-based system (400) according to claim 1, wherein the lift module (210) is configured to hoist and lower the modules (130, 160, 170, 200) or objects from deck level to a height above the lower deck (240).

3. The module-based system (400) according to claim 2, wherein the jack module (170) comprises upper (171) and lower (175) jack segments configured to be opened in two or more sections, moved into and out from a well center and rotated, and an actuator for operation thereof extends through the lower jack segment (175) so that the actuator protrudes below the lower jack segment (175).

4. The module-based system (400) according to claim 2, wherein the transport trolley module (130) and the winch module (200) are adapted for handling a blowout preventer (241), a high pressure riser (280), a wireline blowout preventer (241), a wireline riser (280) and topside completion equipment for a well.

5. The module-based system (400) according to claim 2, further comprising a basket module (180) configured for storing pipes in a vertical position, said basket module (180) being compatible with the pipe manipulator module (160) for handling the vertical pipes in and out of a well center.

6. The module-based system (400) according to claim 2, further comprising hatches (140, 150) arranged to travel on dedicated rails in the frame module (100) configured for one or both of (i) opening or closing an opening in the lower deck (240), and (ii) closing around objects extending through the opening in the lower deck (240).

7. The module-based system (400) according to claim 2, further comprising one or both of a cutter work deck module (110) and a tong work module (120).

8. The module-based system (400) according to claim 2, comprising a common and central control system for all modules (100, 110, 120, 130, 140, 150, 160, 170, 180, 200, 210) and functions so that said modules and functions are controlled by one system and with internal interlockings.

9. The module-based system (400) according to claim 1, wherein the jack module (170) comprises upper (171) and lower (175) jack segments configured to be opened in two or more sections, moved into and out from a well center and rotated, and an actuator for operation thereof extends through the lower jack segment (175) so that the actuator protrudes below the lower jack segment (175).

10. The module-based system (400) according to claim 9, wherein the transport trolley module (130) and the winch module (200) are adapted for handling a blowout preventer (241), a high pressure riser (280), a wireline blowout preventer (241), a wireline riser (280) and topside completion equipment for a well.

11. The module-based system (400) according to claim 1, wherein the transport trolley module (130) and the winch module (200) are adapted for handling a blowout preventer (241), a high pressure riser (280), a wireline blowout preventer (241), a wireline riser (280) and topside completion equipment for a well.

12. The module-based system (400) according to claim 1, further comprising hatches (140, 150) arranged to travel on dedicated rails in the frame module (100) configured for one or both of (i) opening or closing an opening in the lower deck (240), and (ii) closing around objects extending through the opening in the lower deck (240).

13. The module-based system (400) according to claim 1, wherein the transport trolley module (130) is configured to travel on dedicated rails in the frame module (100) for transport of objects to and from a well center.

14. The module-based system (400) according to claim 1, wherein the winch module (200) has redundant load paths, designed such that if one winch system fails the other shall remain intact and a load will not drop.

15. The module-based system (400) according to claim 2, wherein the lift module (210) includes an A-frame and winch (290) that can be tilted in and out of a well center, and the A-frame and winch (290) can be used to run wireline as an integrated part of the module-based system (400).

16. The module-based system (400) according to claim 1, further comprising a basket module (180) configured for storing pipes in a vertical position, said basket module (180) being compatible with the pipe manipulator module (160) for handling the vertical pipes in and out of a well center.

17. The module-based system (400) according to claim 1, further comprising one or both of a cutter work deck module (110) and a tong work module (120).

18. The module-based system (400) according to claim 1, wherein the respective modules (100, 110, 120, 130, 140, 150, 160, 170, 180, 200, 210) have dimensions and weights appropriate for use on fixed installations offshore.

19. The module-based system (400) according to claim 1, wherein the modules (100, 110, 120, 130, 140, 150, 160, 170, 180, 200, 210) comprise quick connections configured to connect energy to the modules (100, 110, 120, 130, 140, 150, 160, 170, 180, 200, 210).

20. The module-based system (400) according to claim 1, comprising a common and central control system for all modules (100, 110, 120, 130, 140, 150, 160, 170, 180, 200, 210) and functions so that said modules and functions are controlled by one system and with internal interlockings.

* * * * *